United States Patent [19]

Huelskamp

[11] 4,076,004

[45] Feb. 28, 1978

[54] HAND LAUNCHER FOR CLAY PIGEONS

[75] Inventor: Urban A. Huelskamp, Dayton, Ohio

[73] Assignee: MTM Molded Products Co., Dayton, Ohio

[21] Appl. No.: 759,235

[22] Filed: Jan. 13, 1977

[51] Int. Cl.[2] ..... F41B 5/00

[52] U.S. Cl. ..... 124/5; 124/41 R

[58] Field of Search ..... 124/5, 4, 41 R, 43, 124/42, 36, 80, 1

[56] References Cited

U.S. PATENT DOCUMENTS

| | | | |
|---|---|---|---|
| 663,090 | 12/1900 | Pike et al. | 124/5 |
| 1,186,098 | 6/1916 | Horst | 124/5 |
| 1,607,874 | 11/1926 | Darton | 124/5 |

FOREIGN PATENT DOCUMENTS

| | | | |
|---|---|---|---|
| 1,434,689 | 5/1976 | United Kingdom | 124/5 |

*Primary Examiner*—William R. Browne

[57] ABSTRACT

A unitary hand launcher for clay pigeons is formed of a single piece of resilient plastic material. The arms of the head portion have flanges which encircle the pigeon, engaging it on its outermost circumference. The flanges are symmetrical, so that the launcher can be inverted for launching pigeons equally well with either the right or left hand.

3 Claims, 7 Drawing Figures

HAND LAUNCHER FOR CLAY PIGEONS

CROSS REFERENCE TO RELATED APPLICATIONS

Reference is made to copending U.S. application Ser. No. 681,439, filed Apr. 29, 1976, and assigned to the assignee of the present application.

BACKGROUND OF THE INVENTION

This invention relates to hand launchers for clay pigeons, and more particularly to a single piece hand launcher which may be more easily manufactured and is less expensive than prior art hand launchers. The hand launcher of the present invention is also more durable, more versatile, and easier to use.

Although the prior art shows many examples of hand launchers for clay pigeons, only a few are presently on the market. The vast majority, although perhaps appearing reasonable on paper, have apparently failed to survive.

Almost all such devices have in common a means for holding the pigeon until a sufficient propelling force has been developed, and then releasing the pigeon while frictionally retarding it along one side to give it a spin as it is ejected from the launcher. Unfortunately, while the concept is simple, putting it into practice has been otherwise. Many of these devices are surprisingly complicated, having springs, triggers, latches, moving arms, pivot points, etc. Even those with relatively simple forms and few moving parts prove, upon further analysis, to have complicated structures which require time, care, and skill in their fabrication. The majority of prior art devices are also limited to launching either by the right hand or the left, but not both.

A need thus remains for an inexpensive, durable, uncomplicated, and versatile hand launcher for clay pigeons which combines the virtues of prior art hand launchers while avoiding their vices.

SUMMARY OF THE INVENTION

Briefly, the present invention provides a unitary hand launcher formed of a single piece of resilient material. In the preferred embodiment, the hand launcher is made of polypropylene and is injection molded in a single forming operation. Thus, the hand launcher of the present invention is formed easily and quickly with a minimum of effort on the part of the machine operator. The present invention has no separately moving parts which might wear or require service or adjustment. Further, due to the relative simplicity of its design and the exclusive use of polypropylene, the present invention is highly resistant to abuse. Typically, therefore, the user may launch his own clay pigeon and immediately drop (or even throw) the launcher while raising his gun to shoot. Neither the impact, nor water or dirt, will damage the launcher.

These advantages are provided in part through the use of an "upwardly and downwardly" symmetrical channel on the head or launching end of the clay pigeon launcher. The channel is formed by a first arm which extends outwardly and laterally away from the handle and the neck portion of the launcher, and a second arm which extends outwardly and laterally opposite the first arm. The end of the first arm opposite the launcher neck is substantially straight. The second arm is substantially curved along its entire length. Both arms are shaped to define a substantially circular opening therebetween having a diameter substantially the same as the outermost diameter of the clay pigeons. Since conventional clay pigeons are approximately 4¼ inches in diameter, the opening between the arms is of a similar size.

Upper and lower opposed flanges extend inwardly from the arms. The flanges both reinforce the arms and define a continuous, single, closed channel in which the clay piegons are individually received for launching. The flanges are symmetrically indentical with respect to one another so that the channel is upwardly and downwardly symmetrical. Further, the flanges define an opening between the arms having a diameter less than the greatest diameter of the clay pigeon but greater than the diameter of any other circumferential rim on the pigeon.

Conventional clay pigeons have a major outer rim and a secondary inner rim which forms a step inwardly from the outer rim. In the present invention the arms and flanges are so dimensioned that the pigeons contact the channel along only the base and sides of the channel, and thus along only the outermost rim of the pigeons. There is substantially no contact between the inner edges of the flanges and any inner rims on the clay pigeon. The clay pigeons may thus be inserted in upright or inverted positions into the launcher, and the launcher can then be used for either right handed or left handed launching. In each case the pigeons are launched in upright position.

The flanges help to reinforce the arms. Additional reinforcement is provided by webs which continuously contact approximately the bottom halves of the arms closest to the neck portion, and extend to and join the neck portion in the vicinity of the head of the launcher. The webs serve to further reinforce and rigidify the portions of the arms adjacent the neck portion, so that the hand launcher will retain the proper shape as it experiences the forces of throwing the pigeon.

As the pigeon is being thrown, the launcher is given a slight snap which creates sufficient force to cause the pigeon to pry the outermost ends of the arms apart to release the pigeon on its trajectory. This action is assisted by the neck portion, which is somewhat thin and flattened to give it some flexibility in the direction in which the pigeons are launched. The neck thus acts as a spring, providing a greater "snap" action in launching the pigeon.

As the pigeon is being launched, the first or straight arm should be the trailing arm, and, as the pigeon rolls out along this arm, it guides the pigeon and establishes the direction in which it is thrown. When the launcher is snapped, the momentum of the pigeon presses it primarily against the outer tip of the curved or leading arm, prying the arms apart so that the pigeon can escape. The increased pressure of the pigeon against the tip of the leading arm also causes the tip to engage the pigeon and give it a spin. At the same time, the opposite side of the pigeon slides through and out of the straight flange of the trailing arm, determining the direction in which the pigeon is thrown. As this occurs, the pigeon rolls on the base of the channel, and therefore on its outermost rim, so that the pigeon is engaged on its strongest part. These features have resulted in a substantially improved, uncomplicated, and easy to use launcher which also causes substantially less pigeon breakage in use.

It is therefore an object of the present invention to provide an inexpensive, unitary hand launcher for clay pigeons formed of a single piece of resilient material, a hand launcher which may be used equally well with either the right or left hand; which engages only the outermost rim of the clay pigeons; and which is durable, uncomplicated, and readily suited for easy fabrication on mass production machinery with a minimum of operator effort.

Other objects and advantages of the invention will be apparent from the following description, the accompanying drawings and the appended claims.

DESCRIPTION OF THE PREFERRED EMBODIMENT

Figure 1:
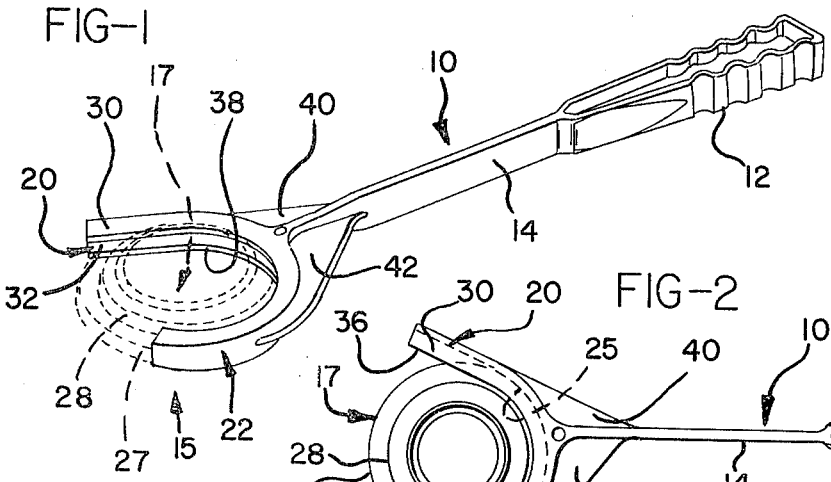
FIG. 1 is a persective view of a hand launcher according to the present invention, with a clay pigeon shown therein in phantom.
Figure 2:
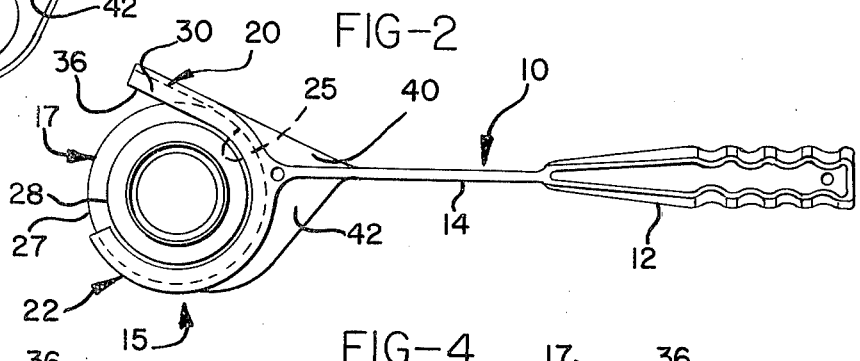
FIG. 2 is a plan view of the launcher with a clay pigeon therein.
Figure 3:
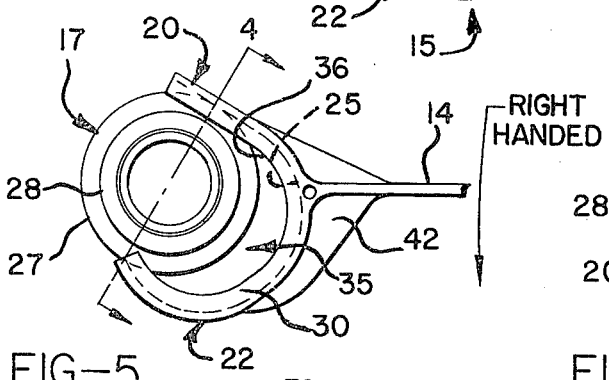
FIG. 3 is a fragmentary plan view illustrating the pigeon at the point of release as it is being thrown with the right hand.
Figure 4:
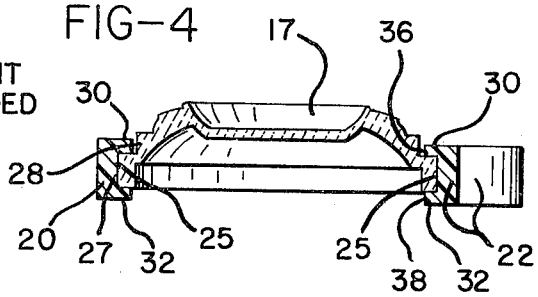
FIG. 4 is a cross sectional view on line 4—4 of FIG. 3.
Figure 5:
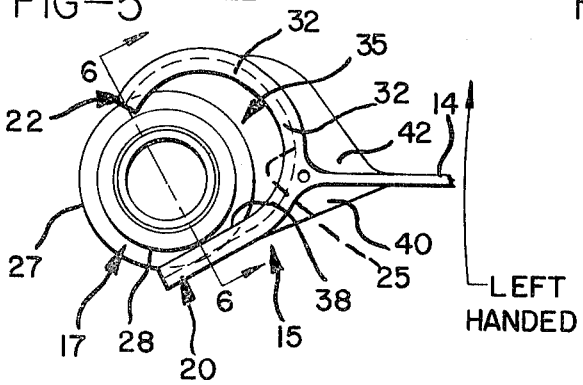
FIG. 5 is a view similar to FIG. 3 showing launching with the left hand.
Figure 6:
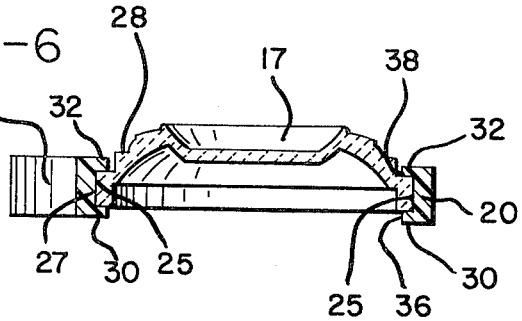
FIG. 6 is a cross sectional view on line 6—6 of FIG. 5.
Figure 7:
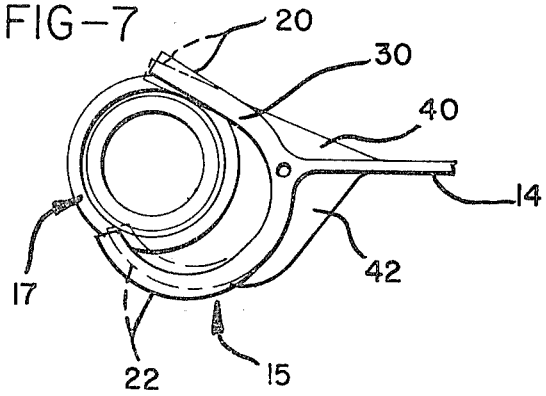
FIG. 7 is a somewhat schematic view illustrating flexing of the ends of the arms during insertion of a pigeon into the head portion of the launcher.

The hand launcher 10 illustrated in FIG. 1 includes a handle portion 12 shaped as a grip, a flexible neck portion 14 extending from the handle portion, and a head portion 15 extending from the neck portion 14 on the end of the launcher opposite the handle portion 12. Launcher 10 is formed of a single piece of material, and in the preferred embodiment is fabricated by injection molding of polypropylene plastic.

The neck portion is designed to be stiff but flexible, acting as a spring during launching of a clay pigeon, such as the pigeon 17 shown in the drawings. In the preferred embodiment, therefore, the neck portion 14 is somewhat flattened and thin, and defines a plane which is vertically disposed as the pigeons are being launched. The head portion 14 can then be "snapped" in a horizontal direction as the pigeon 17 is being ejected. A first or or trailing arm 20 forms a part of the head portion 15 and extends outwardly and laterally away from the neck portion 14. The shape of the first arm 20 adjacent the neck portion 14 is curved for a short distance, and the remainder of the first arm 20 is substantially straight.

A second arm 22 forms another part of the head portion 15. The second arm 22 is substantially curved over its entire length, continuing the curve of the base of the first arm 20, and extending outwardly and laterally from the neck portion 14 opposite the first arm 20. The arms 20 and 22 define a substantially circular opening 25 therebetween which has a diameter substantially the same as the outermost diameter of the clay pigeons 17.

Typically, the clay pigeons are provided with an outermost rim 27 and an inner rim 28 above and slightly inward of the outermost rim 27. The rims 27 and 28 define a step which is used by many prior art hand launchers for supporting and/or engaging the pigeon. The outermost rim 27 is usually structurally stronger than the inner rim 28, and due to the greater moment arm, is a better place to apply force for imparting spin to the pigeon 17. However, due to the design of many of the prior art hand launchers, it is necessary to press against the inner rim 28 to engage and spin the pigeon.

In the present invention, as indicated, the arms 20 and 22 press against only the outermost rim 27 of each pigeon 17. However, in order to keep the pigeons in position within the head portion 15 and between the arms 20 and 22, the head portion includes an upper flange 30 and a symmetrically identical lower flange 32. Flanges 30 and 32 extend inwardly from the upper and lower edges of the first and second arms 20 and 22 to define a continuous, single, closed channel. Thus, the arms 20 and 22 define the shape of the channel, and the flanges 30 and 32 define its size and reinforce the arms.

The flanges define a circular opening 35 having a diameter less than the outermost rim 27 of the clay pigeons 17 and greater than the circumference of any other circumferential rim, such as the inner rim 28. Thus, when a pigeon is received within the channel, it contacts the head portion 15 of the launcher 10 only along the base of the channel defined between arms 20 and 22 and along the inwardly facing surfaces of the flanges 30 and 32. The pigeon is substantially free of contact with the inner edges 36 and 38 of the flanges 30 and 32.

As may be seen from the drawings, the arms 20 and 22 and flanges 30 and 32 surround more than 50% of a pigeon when located and fully seated within the openings 25 and 35. This holds the pigeons within the head portion 15 of the launcher 10, but also requires that the arms 20 and 22 be pried apart for inserting and ejecting the pigeons. As will be appreciated, the arms 20 and 22 must be sufficiently rigid to hold the pigeon until the exact moment it is to be released. As indicated earlier, the upper and lower flanges 30 and 32 provide reinforcement for the arms 20 and 22, so that the arms require far less material and have far less weight than would otherwise be the case. However, even further rigidity has been found beneficial at the base of the arms near the neck portion 14. But, rather than making the arms and flanges thicker and heavier in this area, the present invention provides webs 40 and 42 for the arms 20 and 22 respectively. Webs 40 and 42 are reinforcement webs which extend between the first and second arms 20 and 22 and the neck portion 14 to rigidify the portions of the arms adjacent the neck portion. The webs 40 and 42 thus provide sufficient support and reinforcement in this area, without undue increase in weight, and leave the remainder of the arms 20 and 22 and the flanges 30 and 32 sufficiently resiliently flexible to be pried apart at their outer ends for insertion and ejection of a clay pigeon into and from the openings 25 and 35.

As may be seen from FIGS. 3–6, the head portion 15 can accept pigeons equally well in upright or inverted positions. Thus the hand launcher may be inverted for launching the clay pigeons equally well with either the right or the left hand.

As may be seen, therefore, the present invention provides numerous advantages. In the preferred embodiment, it is uncomplicated, durable, inexpensive, and easy to manufacture. It has proved to be exceptionally easy to use, and is mud, water, and rust proof. It combines the advantages of prior art hand launchers, may be used with either the right or the left hand, and yet avoids virtually all the disadvantages of prior hand launchers.

While the form of apparatus herein described constitutes a preferred embodiment of this invention, it is to be understood that the invention is not limited to this precise form of apparatus, and that changes may be made therein without departing from the scope of the invention.

What is claimed is:

1. A unitary hand launcher for clay pigeons formed of a single piece of resilient material, comprising:

a. a handle portion, b. a flexible neck portion extending from said handle portion, c. a head portion extending from said neck portion on the end of said launcher opposite said handle portion, said head portion including:

i. a trailing arm extending outwardly and laterally away from said neck portion, the end of said trailing arm opposite said neck portion being substantially straight, ii. a substantially curved leading arm extending outwardly and laterally from said neck portion opposite said trailing arm, said arms being shaped to define a substantially circular opening therebetween having a diameter substantially the same as the outermost diameter of a pigeon, for receiving a pigeon within said opening, iii. upper and lower opposed flanges which are substantially symmetrical with respect to one another and extend inwardly from the upper and lower edges of said leading and trailing arms to reinforce said arms, and are spaced to define a channel for receiving the outermost rim of the pigeon therein, said arms defining the base of said channel, said flanges defining the sides thereof, and said arms and flanges being shaped to surround more than 50% of the perimeter of the pigeon when fully seated within said channel, iv. said flanges also being sized to define an opening between the arms having a diameter less than the outermost diameter of the pigeon and greater than the diameter of any rims on the pigeon located inwardly from the outermost edge of the pigeon, to receive a pigeon individually in said channel and to cause a pigeon to contact said head portion of the launcher along only the base and sides of the channel and to be substantially free of contact with the inner edges of the flanges, d. leading and trailing reinforcement webs extending respectively between and attached substantially rigidly to said leading and trailing arms and said neck portion to rigidify and substantially immobilize at least the portions of said arms adjacent said neck portion, the remainder of said arms and flanges being sufficiently resiliently flexible to be pried apart at their outer ends for insertion and ejection of a clay pigeon into and from said openings, and e. said channel accepting a pigeon therein equally well in upright or inverted positions to provide for inverting the hand launcher for launching a clay pigeon equally well with either the right or left hand.

2. A unitary hand launcher for clay pigeons formed of a single pice of resilient material, comprising:

a. a handle portion, b. a flattened flexible neck portion extending from said handle portion, c. a head portion extending from said neck portion on the end of said launcher opposite said handle portion, said head portion including:

i. a trailing arm extending outwardly and laterally away from said neck portion, the end of said trailing arm opposite said neck portion being substantially straight, ii. a substantially curved leading arm extending outwardly and laterally from said neck portion opposite said trailing arm, said arms being shaped to define a substantially circular opening therebetween having a diameter substantially the same as the outermost diameter of the pigeons, for receiving a pigeon within said opening, iii. substantially continuous upper and lower opposed flanges which are substantially symmetrical with respect to one another and extend inwardly from the upper and lower edges of said leading and trailing arms to reinforce said arms, and are spaced to define a single, continuous, closed channel for receiving the outermost rim of the pigeon therein, said arms defining the base of said channel, said flanges defining the sides thereof, and said arms and flanges being shaped to surround more than 50% of the perimeter of the pigeon when fully seated within said channel, iv. said flanges also being sized to define an opening between the arms having a diameter less than the outermost diameter of the pigeon and greater than the diameter of any rims on the pigeon located inwardly from the outermost edge of the pigeon, to receive the pigeons individually in said channel and to cause each pigeon to contact said head portion of the launcher along only the base and sides of the channel and to be substantially free of contact with the inner edges of the flanges, and d. leading and trailing reinforcement webs extending respectively between said leading and trailing arms and said neck portion to rigidify at least the portions of said arms adjacent said neck portion, the remainder of said arms and flanges being sufficiently resiliently flexible to be pried apart at their outer ends for insertion and ejection of a clay pigeon into and from said openings, and e. said channel accepting pigeons therein equally well in upright or inverted positions to provide for inverting the hand launcher for launching clay pigeons equally well with either the right or left hand.

3. A unitary hand launcher for clay pigeons formed of a single piece of resilient material, comprising:

a. a handle portion, b. a flattened flexible neck portion extending from said handle portion, c. a head portion extending from said neck portion on the end of said launcher opposite said handle portion, said head portion including:

i. a trailing rim extending outwardly and laterally away from said neck portion, the end of said trailing arm opposite said neck portion being substantially straight, ii. a substantially curved leading arm extending outwardly and laterally from said neck portion opposite said trailing arm, said arms being shaped to define a substantially circular opening there-between having a diameter substantially the same as the outermost diameter of the pigeons, for receiving a pigeon within said opening, iii. upper and lower opposed flanges which are substantially symmetrical with respect to one another and extend inwardly from the upper and lower edges of said leading and trailing arms to reinforce said arms, are substantially continuous from the end of one arm to the other, and are spaced to define a single, continuous, closed channel for receiving the outermost rim of the pigeon therein, said arms defining the base of said channel, said flanges defining the sides thereof, and said arms and flanges being shaped to surround more than 50% of the perimeter of the pigeon when fully seated within said channel, iv. said flanges also being sized to define an opening between the arms having a diameter less than the outermost diameter of the pigeon and greater than the diameter of any rims on the pigeon located inwardly from the outermost edge of the pigeon, to receive the pigeons individually in said channel and to cause each pigeon to contact said head portion of the launcher along only the base and sides of the channel and to be substantially free of contact with the inner edges of the flanges, and d. said channel accepting pigeons therein equally well in upright or inverted positions to provide for inverting the hand launcher for launching clay pigeons equally well with either the right or left hand.

* * * * *